US006883252B2

(12) United States Patent
Cagner

(10) Patent No.: US 6,883,252 B2
(45) Date of Patent: Apr. 26, 2005

(54) FOOTWEAR WITH INSOLE REINFORCEMENT

(75) Inventor: M. Bruce Cagner, Dix Hills, NY (US)

(73) Assignee: BCNY International, Hicksville, NY (US)

( * ) Notice: Subject to any disclaimer, the term of this patent is extended or adjusted under 35 U.S.C. 154(b) by 0 days.

(21) Appl. No.: 10/627,259

(22) Filed: Jul. 25, 2003

(65) Prior Publication Data

US 2005/0016018 A1 Jan. 27, 2005

(51) Int. Cl.[7] ..... A43B 3/12
(52) U.S. Cl. ..... 36/11.5; 36/12
(58) Field of Search ..... 36/11.5, 12, 94, 36/15, 100, 101

(56) References Cited

U.S. PATENT DOCUMENTS

| | | | | | |
|---|---|---|---|---|---|
| 1,681,548 | A | * | 8/1928 | Jacob | 36/11.5 |
| 1,803,554 | A | * | 5/1931 | Knilans | 36/114 |
| 2,724,913 | A | * | 11/1955 | Russell | 36/11.5 |
| 2,947,095 | A | * | 8/1960 | Miyachi | 36/11.5 |
| 3,698,107 | A | * | 10/1972 | Fukuoka | 36/11.5 |
| 3,930,322 | A | * | 1/1976 | Endo et al. | 36/11.5 |
| 3,978,596 | A | * | 9/1976 | Brown et al. | 36/11.5 |
| 4,069,601 | A | * | 1/1978 | Robbins et al. | 36/11.5 |
| 4,172,330 | A | * | 10/1979 | Kao | 36/11.5 |
| 4,300,256 | A | * | 11/1981 | Laganas | 12/142 F |
| 5,651,195 | A | * | 7/1997 | Clancy | 36/11.5 |
| D449,918 | S | | 11/2001 | Boncutter | |
| D450,177 | S | | 11/2001 | Boncutter | |
| D450,178 | S | | 11/2001 | Boncutter | |
| D454,425 | S | | 3/2002 | Boncutter | |
| 6,477,790 | B1 | | 11/2002 | Boncutter et al. | |
| 6,508,016 | B1 | | 1/2003 | Boncutter et al. | |
| 2002/0092200 | A1 | * | 7/2002 | Boncutter et al. | 36/11.5 |

FOREIGN PATENT DOCUMENTS

| | | | |
|---|---|---|---|
| FR | 2595213 | * | 9/1987 |

* cited by examiner

*Primary Examiner*—M. D. Patterson
(74) *Attorney, Agent, or Firm*—R. Neil Sudol; Henry D. Coleman; William J. Sapone

(57) ABSTRACT

A shoe include an outsole, an insole, an upper, and a reinforcement member. The insole is attached to the outsole along an upper surface thereof and is provided with at least one aperture extending through the insole to the upper surface of the outsole. The upper includes an elongate element extending into the aperture. The reinforcement member is attached to the insole at least along an upper side of the aperture for protecting material of the insole from stresses arising from movement of the elongate element of the upper.

20 Claims, 2 Drawing Sheets

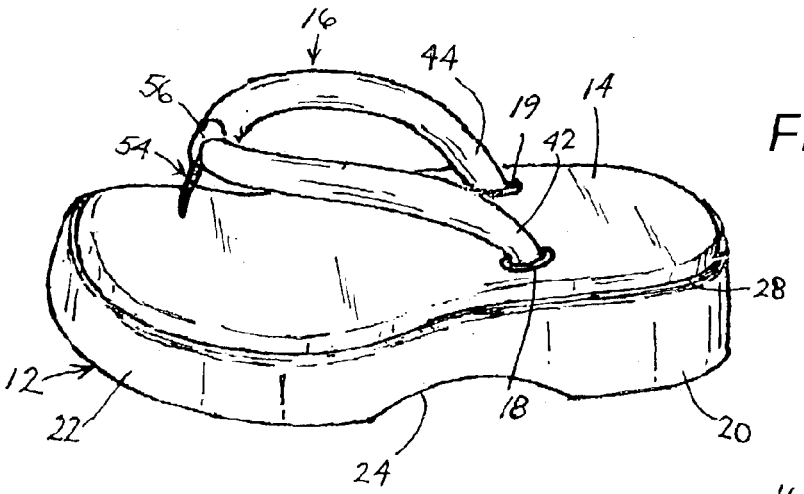
FIG. 1
FIG. 2
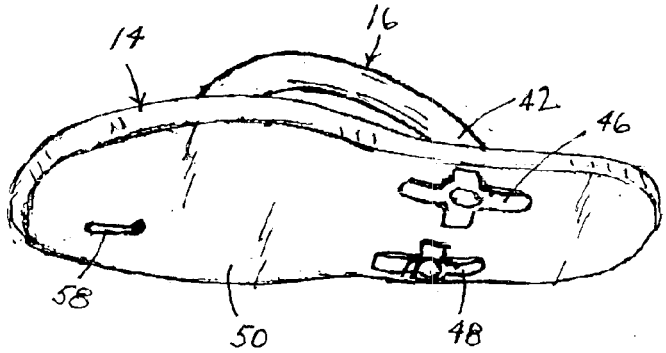
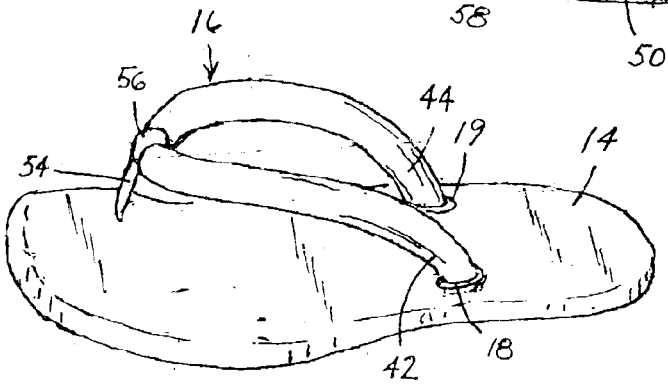
FIG. 3
FIG. 4
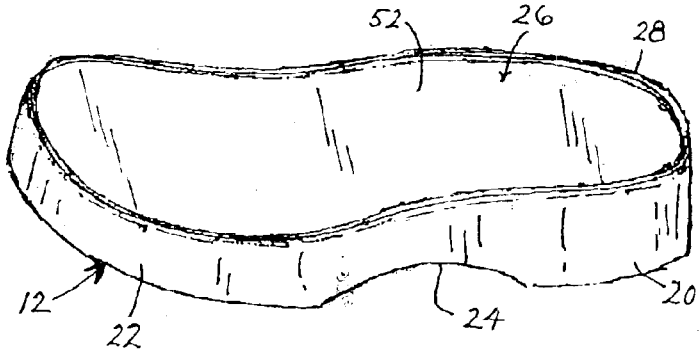

FOOTWEAR WITH INSOLE REINFORCEMENT

BACKGROUND OF THE INVENTION

The present invention is directed to an article of footwear.

A style of footwear of increasing popularity is the thong-type sandal, formerly known in some areas of the United States as a flip-flop. Decades ago, this style of footwear was largely found in the home or on the beach. In its conventional form, the thong slipper had a sole made of a foam type material and a wishbone-shaped upper made of a rubbery synthetic resin material. The sole was planar and provided with three apertures receiving the three free ends of the upper. Typically, the free ends of the upper were formed with heads seated in enlarged portions of the sole apertures, at the bottom surface of the sole.

The current wave of popularity of the thong-type sandal is fueled principally because of stylistic modifications, such as the addition of a high heel, the provision of an outsole and an insole, and materials such as vinyl-coated thermoplastic resin for the insole and even the upper.

The thong-type sandal is therefore in the process of being refashioned from mere beachwear to a more general-purpose shoe.

OBJECTS OF THE INVENTION

An object of the present invention is to provide an article of footwear.

Another object of the present invention is to provide a thong-sandal that is suitable for the greater physical demands imposed on a shoe of general street use.

A further object of the present invention is to provide such an article of footwear that is inexpensive to manufacture.

It is an additional object of the present invention to provide such an article of footwear that can be attractively fashioned.

These and other objects of the invention will be apparent from the drawings and descriptions herein. Every object of the invention is realized in at least one embodiment of the invention. However, there is not necessarily any embodiment that achieves all of the objects of the invention.

SUMMARY OF THE INVENTION

A shoe in accordance with the present invention comprises an outsole, an insole, an upper, and a reinforcement member. The insole is attached to the outsole along an upper surface thereof and is provided with at least one aperture extending through the insole to the upper surface of the outsole. The upper includes an elongate element extending into the aperture. The reinforcement member is attached to the insole at least along an upper side of the aperture for protecting material of the insole from stresses arising from movement of the elongate element of the upper.

The reinforcement member preferably takes the form of a grommet inserted into the aperture. The elongate element of the upper extends into the grommet and is attached at least indirectly to the outsole.

Pursuant to another feature of the invention, the grommet extends only partway into the aperture. The grommet has a cylindrical portion that extends into the aperture and is substantially shorter than the aperture. Preferably, the grommet includes a flange bonded to an upper surface of the insole.

In one embodiment of the shoe, the elongate element is a tubular strap. This is the case where the shoe takes the form of a thong-type sandal. The thong-type upper has a generally Y or wishbone shape, with at least two free ends (the legs of the Y) being inserted through respective apertures in the insole. Each aperture is provided with a respective reinforcement member preferably in the form of a grommet. The end portions of the upper are attached at least indirectly to the outsole.

The upper surface of the outsole may be located in a recess on an upper side of the outsole. In that case, the insole is less wide than the outsole and is seated in the recess. This design provides additional support to the insole, since the lower side and particularly the lower edges of the insole are contained in the recess. Thus, the outsole can be made of a relatively hard tough material (such as ethylene vinyl acetate or EVA) while the insole is made of a cushioning thermoplastic foam material.

Pursuant to a specific feature of the present invention, the tubular strap is split at an end to form a plurality of flaps or flattened fingers. The flaps are disposed between a lower surface of the insole and the upper surface of the outsole and are bonded to that upper surface.

Preferably, the grommet includes a flange bonded to an upper surface of the insole. In an alternate embodiment of the invention, the reinforcement member may take the form of a ring bonded to the upper surface of the insole around the aperture. Alternatively, the grommet may take the form of a ring or cylinder inserted into the aperture and bonded to the insole along the sidewall of the aperture.

BRIEF DESCRIPTION OF THE DRAWING

FIG. 1 is a schematic top and side perspective view of an article of footwear in accordance with the present invention.

FIG. 2 is a schematic bottom and side perspective view of an insole and an upper shown in FIG. 1.

FIG. 3 is a schematic top and side perspective view of the insole and upper of FIGS. 1 and 2.

FIG. 4 is a schematic top and side perspective view of an outsole shown in FIG. 1.

DETAILED DESCRIPTION OF THE PREFERRED EMBODIMENTS

Figure 5:
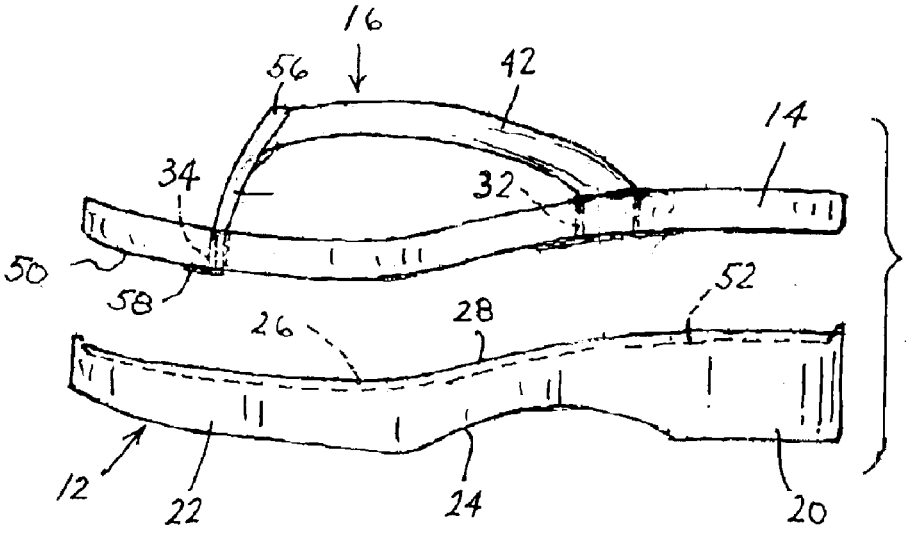
FIG. 5 is schematic partially exploded side elevational view of the outsole, insole, and upper of FIG. 1.

As shown in FIG. 1, a thong-type sandal shoe comprises an outsole 12, an insole 14, an upper 16, and reinforcement members in the form of grommets 18 and 19. As depicted in FIGS. 1 and 4, outsole 12 is a thick member having a heel portion 20 and a forefoot portion 22 separated by a sculpted recess 24 along the instep portion of the shoe. On an upper side, outsole 12 is formed with a shallow recess 26 bounded by a lip or rim 28 extending along an outer edge of the outsole. Outsole is preferably made of a tough and durable material such as ethylene vinyl acetate (EVA), while insole 14 is made of a thermoplastic resin foam 27 surrounded by a vinyl coating 29 (FIG. 6).

Figure 6:
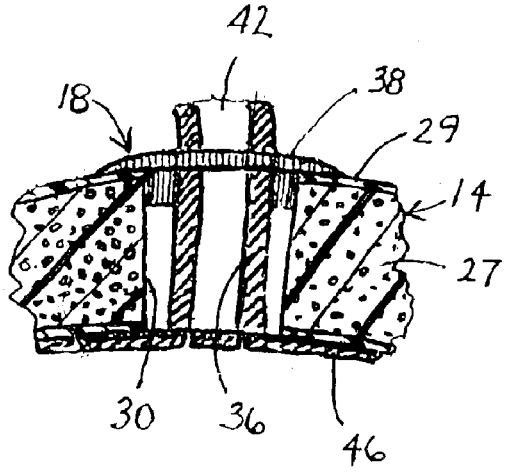
FIG. 6 is a cross-sectional view, on a larger scale, of a reinforcement member or grommet shown in FIGS. 1, 2 and 5.

With reference to FIGS. 1–3, 5, and 6, insole 14 is a profiled slab of thermoplastic foam material provided along at least its outer surfaces (not labeled) with a vinyl coating. Insole 14 is provided with three apertures or through-holes 30, 32, and 34. Apertures 30 and 32 are provided with grommets 18 and 19. As illustrated in FIG. 6, each grommet, for instance, grommet 18, includes a cylindrical portion 36 inserted into the upper end of the respective aperture 30 and further includes an annular flange 38. The grommets 18 and 19 are bonded to insole 14. More specifically, flange 38 is adhesively attached to an upper surface of insole 14. Alternatively or additionally, cylindrical portion is adhesively coupled to a sidewall (not separately labeled) of the respective aperture 30, 32.

The seating of insole 14 on a substantially larger outsole 12 results in a shoe that is more sturdy, stable, and pronation resistant than a shoe where the insole is larger than the outsole, and more particularly where the insole overlaps and extends out beyond the outsole.

Upper 16 includes a tubular strap member 40 having elongate free ends 42 and 44 respectively inserted through grommets 18 and 19 and apertures 30 and 32. Strap ends 42 and 44 are cut at their free ends to form two sets of flaps 46 and 48 splayed out along an under surface 50 of insole 14. Flaps 46 and 48, as well as under surface 50 are adhesively bonded to an upper surface 52 of outsole 12. Upper surface 52 is the lower surface of recess 26 and is accordingly defined by lip or rim 28.

Upper 16 further includes a finger or tongue 54 attached to tubular strap member 40 along a midsection thereof. Finger 54 may include a loop 56 that extends around strap member 40. Finger 54 extends through aperture 34 and has an end portion 58 attached to upper surface 52 of outsole 12. Finger 54 typically includes a fabric piece with a sleeve spacer (not separately illustrated between an upper surface of insole 14 and loop 56. Aperture 34 may be provided with a grommet (not shown) as described above. The grommets 18, 19 protect the material of insole 14 from stresses arising from movement of elongate strap ends 42 and 44 during the use of the shoe.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A shoe comprising:

an outsole;

an insole provided with at least one aperture, said insole being attached to said outsole along an upper surface thereof, said aperture extending through said insole to said upper surface of said outsole;

an upper including an elongate element; and a grommet inserted into said aperture, said elongate element extending into said grommet and attached at least indirectly to said outsole, said grommet extending only partway into said aperture from an upper surface of said insole, said grommet being spaced from said upper surface of said outsole.

2. The shoe defined in claim 1 wherein said aperture has a first length and said grommet has a cylindrical portion with a second length substantially shorter than said first length, said cylindrical portion extending into said aperture from said upper surface of said insole, said cylindrical portion being spaced from said upper surface of said outsole.

3. The shoe defined in claim 2 wherein said grommet includes a flange bonded to said upper surface of said insole.

4. The shoe defined in claim 3 wherein said elongate element is a tubular strap.

5. The shoe defined in claim 4 wherein said upper is a thong type upper, said insole being provided with at least one other aperture and an additional grommet extending at least partway into said aperture, said strap being one end portion of said upper, said upper having another end portion inserted through said additional grommet and said other aperture, said another end portion being fixed at least indirectly to said outsole.

6. The shoe defined in claim 5 wherein said upper surface of said outsole is located in a recess on an upper side of said outsole, said insole being seated in said recess.

7. The shoe defined in claim 4 wherein said tubular strap is split at an end to form a plurality of flaps, said flaps being disposed between a lower surface of said insole and said upper surface of said outsole, said flaps being bonded to said upper surface of said outsole.

8. The shoe defined in claim 1 wherein said grommet includes a flange bonded to said upper surface of said insole.

9. The shoe defined in claim 1 wherein said elongate element is a tubular strap.

10. The shoe defined in claim 1 wherein said upper is a thong type upper, said insole being provided with at least one other aperture and an additional grommet inserted into said aperture, said elongate element being one portion of said upper, said upper having another portion inserted through said additional grommet and said other aperture, said another portion being fixed at least indirectly to said outsole.

11. The shoe defined in claim 1 wherein said upper surface of said outsole is located in a recess on an upper side of said outsole, said insole being seated in said recess.

12. The shoe defined in claim 1 wherein said insole is a thermoplastic resin foam material provided with a vinyl coating.

13. The shoe defined in claim 1 wherein said outsole is made of ethylene vinyl acetate.

14. The shoe defined in claim 1 wherein said grommet has a cylindrical portion extending into said aperture.

15. The shoe defined in claim 1 wherein said outsole is substantially thicker than said insole.

16. The shoe defined in claim 1 wherein said outsole has a heel portion and a forefoot portion separated by an instep recess.

17. The shoe defined in claim 1 wherein said insole is adhesively bonded to said upper surface of said outsole.

18. A shoe comprising:

an outsole;

an insole provided with at least one aperture, said insole being attached to said outsole along an upper surface thereof, said aperture extending through said insole to said upper surface of said outsole;

an upper including an elongate element inserted through said aperture; and a reinforcement member attached to said insole at least along only an upper side of said aperture for protecting material of said insole from stresses inflicted by said elongate element of said upper.

19. The shoe defined in claim 18 wherein said reinforcement element is a grommet extending into said aperture.

20. A shoe comprising:

an outsole;

an insole provided with at least one aperture, said insole being attached to said outsole along an upper surface thereof, said aperture extending through said insole to said upper surface of said outsole;

an upper including an elongate element; and a grommet inserted into said aperture, said elongate element extending into said grommet and attached at least indirectly to said outsole, said grommet including a flange adhesively bonded to an upper surface of said insole.

* * * * *